US010203150B2

(12) United States Patent
Jeong et al.

(10) Patent No.: US 10,203,150 B2
(45) Date of Patent: Feb. 12, 2019

(54) INDOOR DEVICE FOR AIR CONDITIONER

(71) Applicant: LG ELECTRONICS INC., Seoul (KR)

(72) Inventors: Changhoon Jeong, Seoul (KR); Suhyun An, Seoul (KR); Huijae Kwon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 826 days.

(21) Appl. No.: 14/510,599

(22) Filed: Oct. 9, 2014

(65) Prior Publication Data

US 2015/0105013 A1 Apr. 16, 2015

(30) Foreign Application Priority Data

Oct. 11, 2013 (KR) ..... 10-2013-0120944

(51) Int. Cl.

| | |
|---|---|
| ***F21V 33/00*** | (2006.01) |
| ***F24F 13/20*** | (2006.01) |
| ***F25D 23/10*** | (2006.01) |
| ***F25D 27/00*** | (2006.01) |
| ***F24F 11/30*** | (2018.01) |
| ***F24F 11/62*** | (2018.01) |
| *F24F 1/00* | (2011.01) |
| *F21Y 115/10* | (2016.01) |
| *F24F 11/56* | (2018.01) |
| *F24F 11/52* | (2018.01) |

(52) U.S. Cl.

CPC ..... *F25D 23/10* (2013.01); *F21V 33/0092* (2013.01); *F24F 1/0007* (2013.01); *F24F 11/30* (2018.01); *F24F 11/62* (2018.01); *F25D 27/005* (2013.01); *F21Y 2115/10* (2016.08); *F24F 11/52* (2018.01); *F24F 11/56* (2018.01); *F24F 2001/0037* (2013.01)

(58) Field of Classification Search

None

See application file for complete search history.

(56) References Cited

U.S. PATENT DOCUMENTS

| | | | | |
|---|---|---|---|---|
| 5,642,608 A | | 7/1997 | Sanderson | |
| 5,746,655 A | * | 5/1998 | Lee | F24F 13/06 454/233 |
| 5,769,710 A | * | 6/1998 | Kim | F24F 13/06 454/321 |

(Continued)

FOREIGN PATENT DOCUMENTS

| | | |
|---|---|---|
| CN | 2420551 | 2/2001 |
| CN | 1478188 | 2/2004 |

(Continued)

OTHER PUBLICATIONS

Chinese Office Action dated Nov. 7, 2016.

(Continued)

*Primary Examiner* — Avinash A Savani
*Assistant Examiner* — Martha M Becton
(74) *Attorney, Agent, or Firm* — KED & Associates LLP

(57) ABSTRACT

An indoor device for an air conditioner is provided. Display of an operation state of the indoor device and reception of an operation signal of a remoter controller may be performed through a single window, reducing production costs and realizing a more elegant exterior.

17 Claims, 16 Drawing Sheets

(56) References Cited

U.S. PATENT DOCUMENTS 5,775,989 A * 7/1998 Choi ..... F24F 1/0007 454/256
5,788,570 A * 8/1998 Cho ..... F24F 1/0011 454/233
5,943,872 A * 8/1999 Sakurada ..... F24F 1/0011 454/155
6,089,972 A 7/2000 Gunji
6,250,373 B1 6/2001 Vecchi
6,264,552 B1 7/2001 Oya
6,393,856 B1 5/2002 Gunji
6,598,413 B2 7/2003 Asahina et al.
6,692,349 B1 * 2/2004 Brinkerhoff ..... F24F 7/00 454/256
7,878,017 B2 * 2/2011 Yasutomi ..... F24F 1/0007 236/91 D
7,908,879 B1 * 3/2011 Chen ..... F24F 1/0007 62/259.1
7,992,794 B2 * 8/2011 Leen ..... G05D 23/1931 236/51
8,230,693 B2 7/2012 Tsuji
8,393,550 B2 * 3/2013 Simon ..... F24F 11/0012 236/51
8,511,108 B2 8/2013 Yabu
8,715,047 B2 5/2014 Kim
8,740,101 B2 * 6/2014 Leen ..... G05D 23/1931 236/51
8,746,583 B2 * 6/2014 Simon ..... F24F 11/0012 236/94
9,410,714 B2 * 8/2016 Tsuji ..... F24F 11/0086
9,574,781 B2 * 2/2017 Tsuji ..... F24F 1/0007
2001/0054493 A1 12/2001 Hatanaka
2003/0157883 A1 * 8/2003 Kwak ..... F24F 13/06 454/258
2004/0166797 A1 * 8/2004 Thrasher ..... F24F 11/006 454/290
2005/0053465 A1 * 3/2005 Roach ..... F04D 25/10 416/101
2005/0109047 A1 * 5/2005 Park ..... F24F 11/0086 62/125
2007/0066215 A1 * 3/2007 Song ..... B01D 46/0004 454/329
2007/0261425 A1 * 11/2007 Yasutomi ..... F24F 1/0007 62/263
2009/0077987 A1 * 3/2009 Egawa ..... F24F 1/0007 62/259.1
2009/0199583 A1 * 8/2009 Jeon ..... F24F 1/0011 62/259.1
2010/0006660 A1 * 1/2010 Leen ..... G05D 23/1931 236/51
2010/0192610 A1 * 8/2010 Yoshitake ..... F24F 1/0007 62/291
2010/0193592 A1 * 8/2010 Simon ..... F24F 11/0012 236/51
2010/0225012 A1 * 9/2010 Fitton ..... F24F 1/01 261/116
2010/0226801 A1 * 9/2010 Gammack ..... F04D 25/08 417/423.1
2010/0287966 A1 11/2010 Cha
2011/0048057 A1 3/2011 Lee et al.
2011/0137467 A1 * 6/2011 Leen ..... G05D 23/1931 700/276
2011/0319009 A1 * 12/2011 Nam ..... F24F 1/0007 454/256
2012/0003917 A1 1/2012 Jeong
2012/0033952 A1 * 2/2012 Wallace ..... F04D 25/08 392/367
2012/0214399 A1 * 8/2012 Tsuji ..... F24F 1/0007 454/333
2012/0220212 A1 * 8/2012 Tsuji ..... F24F 11/0086 454/333
2012/0288363 A1 * 11/2012 Yumoto ..... F24F 1/0014 415/182.1
2013/0186964 A1 * 7/2013 Simon ..... F24F 11/0012 236/51
2013/0280099 A1 * 10/2013 Park ..... F04B 49/20 417/42
2014/0026604 A1 * 1/2014 Yoshimura ..... F25D 29/00 62/180

FOREIGN PATENT DOCUMENTS

CN 1499141 5/2004
CN 1517613 8/2004
CN 1573239 2/2005
CN 1712808 12/2005
CN 1727764 2/2006
CN 101464041 6/2009
CN 201368569 12/2009
CN 101761986 6/2010
CN 101796349 8/2010
CN 102478304 5/2012
CN 102575869 7/2012
CN 202630252 12/2012
EP 0 884 542 12/1998
EP 0 926 451 6/1999
EP 1 003 002 A2 5/2000
EP 1 152 193 11/2001
EP 1271065 A2 1/2003
EP 1 326 055 A1 7/2003
EP 1 482 252 A2 12/2004
EP 1 533 577 A1 5/2005
EP 1 548 375 A1 6/2005
EP 1 813 875 A1 8/2007
EP 1 816 406 A2 8/2007
EP 1 837 607 A2 9/2007
EP 1 947 397 A1 7/2008
EP 2 017 542 A1 1/2009
EP 2023049 A2 2/2009
EP 2 199 695 A1 6/2010
EP 2 363 653 A2 9/2011
EP 2 498 018 A1 9/2012
EP 2 530 395 A1 12/2012
EP 3 006 840 4/2016
JP S58-173320 A 10/1983
JP H11-148698 A 6/1999
JP 2001-173982 A 6/2001
JP 2002-228183 A 8/2002
JP 2003-042515 2/2003
JP 2003-065558 A 3/2003
JP 2004-138363 A 5/2004
JP 2009-168347 7/2009
JP 2012-220110 A 11/2012
JP 3183736 U 5/2013
KR 1996-0004920 6/1996
KR 20-0161129 11/1999
KR 10-2000-0035591 A 6/2000
KR 10-2005-0083664 A 8/2005
KR 10-0583415 B1 5/2006
KR 10-2006-0062148 6/2006
KR 10-2007-0058682 A 6/2007
KR 10-2007-0095141 9/2007
KR 10-0794596 B1 1/2008
KR 10-2008-0075632 A 8/2008
KR 10-2007-0080383 A 2/2009
KR 10-20100036919 4/2010
KR 20-2012-0004065 U 2/2012
KR 10-2012-0082934 A 7/2012
WO WO 2004/011854 A1 2/2004
WO WO 2004/040204 5/2004

OTHER PUBLICATIONS

European Search Report issued in Application No. 14185283.0 dated Feb. 4, 2015.
European Search Report issued in Application No. 14185285.5 dated Feb. 4, 2015.
European Search Report issued in Application No. 14187785.2 dated Feb. 4, 2015.
Chinese Office Action dated Nov. 9, 2016 issued in Application No. 201410270547.3 (Translation).

(56) References Cited

OTHER PUBLICATIONS

Chinese Office Action dated Nov. 9, 2016 issued in Application No. 201410495092.5 (Translation).
Korean Office Action dated Aug. 19, 2016 issued in Application No. 10-2013-0117978.
U.S. Office Action dated Oct. 20, 2016 issued in U.S. Appl. No. 14/508,161.
Korean Office Action dated Feb. 2, 2017.
U.S. Office Action issued in U.S. Appl. No. 14/508,161 dated Mar. 16, 2017.
European Search Report dated Feb. 24, 2015 issued in Application No. 14186801.8.
Chinese Office Action dated Oct. 13, 2016.
Korean Office Action issued in Application No. 10-2013-0117978 dated Feb. 26, 2016.
Korean Office Action issued in Application No. 10-2014-0009419 dated Mar. 2, 2016.
Chinese Office Action dated Feb. 23, 2017 (English Translation).
Korean Office Action dated Mar. 7, 2016 issued in Application No. 10-2013-0120944.
European Search Report issued in Application No. 14188794.3 dated Jun. 24, 2015.
United States Office Action dated Dec. 14, 2017 issued in co-pending U.S. Appl. No. 14/504,823.
Korea Office Action dated Jul. 3, 2017.
Chinese Office Action dated Jul. 19, 2017 (English Translation).
U.S. Office Action issued in U.S. Appl. No. 14/504,823 dated Jul. 25, 2017.
U.S. Office Action issued in U.S. Appl. No. 14/505,190 dated Aug. 2, 2017.
Machine English Translation of CN 1727764, previously cited.
U.S. Appl. No. 14/505,190 filed Oct. 2, 2014.
U.S. Appl. No. 14/504,823, filed Oct. 2, 2014.
U.S. Appl. No. 14/508,161, filed Oct. 7, 2014.
U.S. Appl. No. 14/510,340, filed Oct. 9, 2014.
Korean Office Action dated Feb. 17, 2016 issued in Application No. 10-2013-0117925.
U.S. Office Action issued in U.S. Appl. No. 14/510,340 dated Feb. 7, 2018.
U.S. Office Action issued in U.S. Appl. No. 14/508,161 dated Feb. 9, 2018.
United States Notice of Allowance dated Oct. 5, 2018 issued in co-pending related U.S. Appl. No. 14/510,340.

* cited by examiner

INDOOR DEVICE FOR AIR CONDITIONER

CROSS-REFERENCE TO RELATED APPLICATION(S)

The present application claims priority under 35 U.S.C. 119 and 35 U.S.C. 365 to Korean Patent Application No. 10-2013-0120944, filed in Korea on Oct. 11, 2013, which is hereby incorporated by reference in its entirety.

BACKGROUND

1. Field

An indoor device for an air conditioner is disclosed herein.

2. Background

In general, air conditioners are cooling/heating systems in which indoor air is suctioned in and heat-exchanged with a low or high-temperature refrigerant, and then the heat-exchanged air is discharged into an indoor space to cool or heat the indoor space. The above-described processes are repeatedly performed. Air conditioners may generate a series of cycles using a compressor, a condenser, an expansion valve, and an evaporator.

In particular, such an air conditioner may include an outdoor unit or device (which is called an "outdoor side" or "heat dissipation side"), which is generally installed in an outdoor space, and an indoor unit or device (which is called an "indoor side" or "heat absorption side"), which is generally installed in a building. The outdoor device may include a condenser, that is, an outdoor heat exchanger, and a compressor, and the indoor device, that is, an indoor heat exchanger, may include an evaporator.

As is well known, air conditioners may be divided into split type air conditioners with outdoor and indoor devices, that are installed separately from, each other, and integrated type air conditioners with outdoor and indoor devices, that are integrally installed with each other. When considering a space in which the air conditioner is to be installed or noise, the split type air conditioner may be preferable.

In a multi type air conditioner of such a split type air conditioner, a plurality of indoor devices ma be connected to one outdoor device. Thus, as the plurality of indoor devices may be respectively installed in indoor spaces for air-conditioning, an effect as if a plurality of air conditioners are installed may be achieved.

Hereinafter, an indoor device for an air conditioner in a general multi type air conditioner will be described with reference to the accompanying drawing.

FIG. 1 is a perspective view illustrating an exterior of an indoor device for an air conditioner according to the related art. As illustrated in FIG. 1, an indoor unit or device 1 may be maintained in a state in which an upper portion of the indoor device 1 is fixed to as inside of a ceiling and hung on the ceiling, and a bottom surface of the indoor device 1 is exposed to a lower side of the ceiling to suction in indoor air and then discharge the suctioned air into the indoor space. In the indoor device 1, as most of the main body is disposed in the ceiling, only a front panel 10 and suction grill 20 may be viewable when a user look up to see the ceiling.

The front panel 10 may define an exterior edge of the bottom surface of the indoor device 1. A suction hole 11, which may be provided in a square shape, may be defined in a central portion of the front panel 10 to guide introduction of the indoor air into the indoor device 1. A plurality of discharge holes 12, which may be provided to guide the air so that the air conditioned in the indoor device 1 may be discharged again into the indoor space, may be defined outside of the suction hole 11. A vane 13 to adjust a flow direction of the discharged air may be rotatably disposed inside each discharge hole 12.

The suction grill 20, which may have an approximately square plate shape and in which a plurality of holes, through which air may pass may be defined, may be mounted on the central portion of the front panel 10, that is, inside the suction hole 11. Thus, when the indoor device 1 operates, indoor air may be suctioned into the indoor device 1 through the suction grill 20, and then, may be heat-exchanged within the indoor device 1 and discharged into an indoor space through the discharge hole 12.

To operate the indoor device 1, a user's manipulation may be needed. As the indoor device 1 is installed in the ceiling in the indoor space, a user has to manipulate the indoor device 1 using a portable remote controller or a remote controller buried in a wall to operate the air conditioner.

Thus, a display 30 to receive a manipulation signal of the remote controller and display the manipulated state may be disposed on a front panel 10 of the indoor device 1. The display 30 may include a plurality of display portions 31 to display an operation state through an LED, and a receiver 32 to receive the manipulation signal of the remote controller.

However, in the indoor device 1 according to the related art, the plurality of display portions 31 and the receiver 32 may be exposed to the outside, deteriorating an exterior appearance of the indoor device 1, and also, service work may be difficult.

BRIEF DESCRIPTION OF THE DRAWINGS

Embodiments will be described in detail with reference to the following drawings in which like reference numerals refer to like elements, and wherein.

DETAILED DESCRIPTION

Reference will now be made in detail to embodiments, examples of which are illustrated in the accompanying drawings. The embodiments may, however, be embodied in many different forms and should not be construed as being limited to the embodiments set forth herein; rather, alternate embodiments included in other retrogressive inventions or falling within the spirit and scope will fully convey the concept to those skilled in the art.

Figure 1:
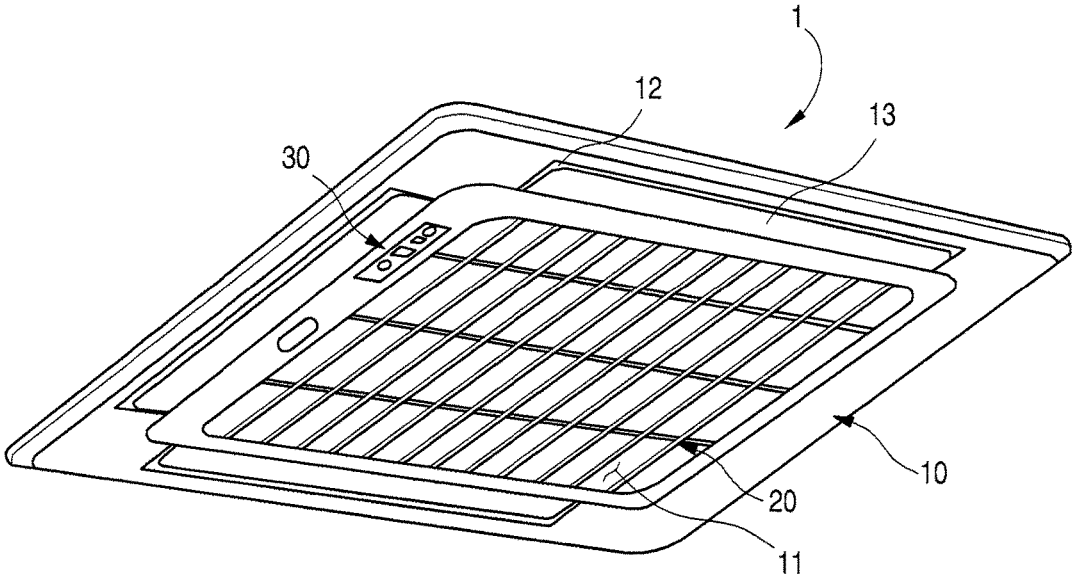
FIG. 1 is a perspective view of an indoor device for an air conditioner mounted in an indoor space according to the related art.
Figure 2:
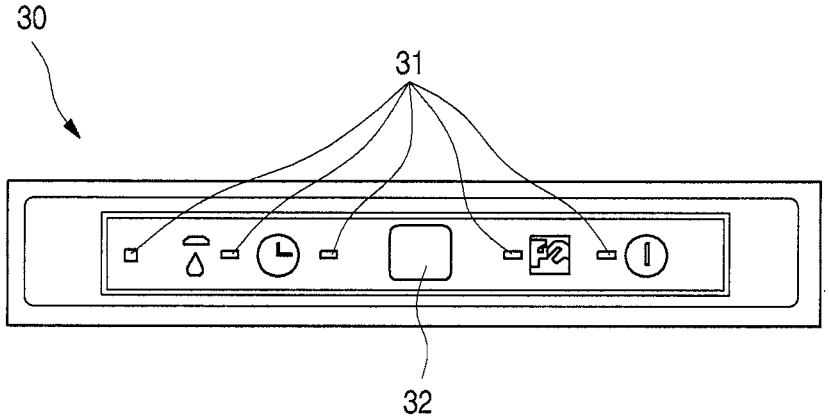
FIG. 2 is a front view of a display of the indoor device for an air conditioner according to the related art.
Figure 3:
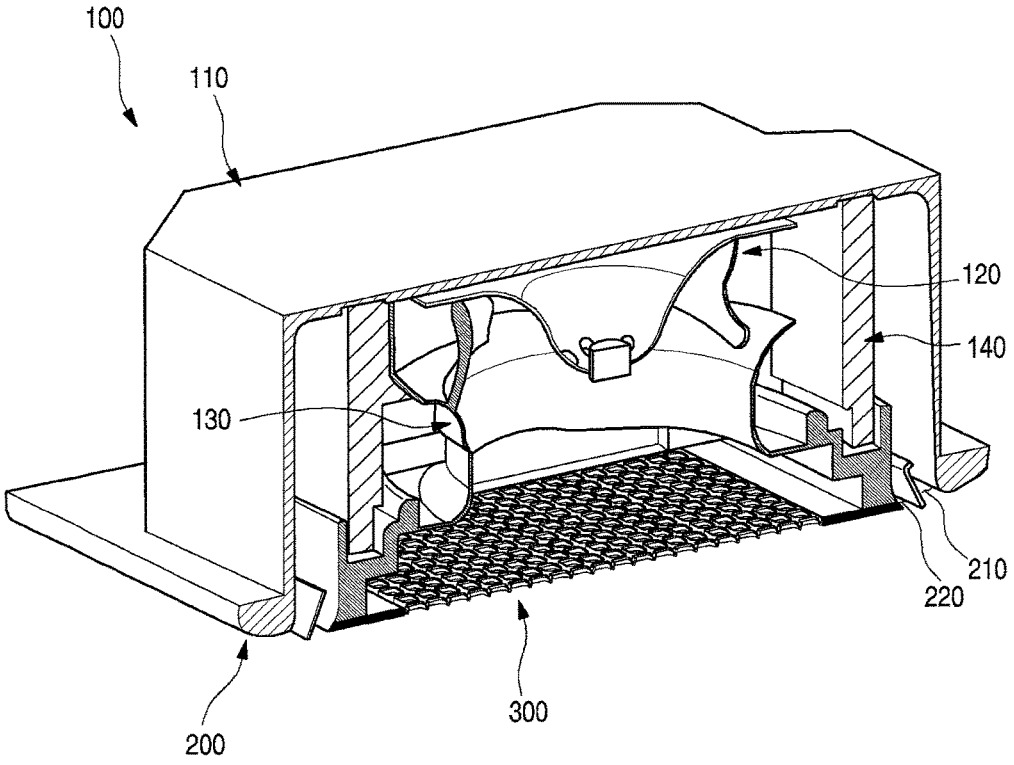
FIG. 3 is a schematic cutoff perspective view of an indoor device for an air conditioner according to an embodiment.

FIG. 3 is a schematic cutoff perspective view of an indoor device for an air conditioner according to an embodiment. As illustrated in the drawings, an indoor unit or device 100 of an air conditioner (hereinafter, referred to as an "indoor device") according to embodiments may include a cabinet 110 inserted into a ceiling in an indoor space, and a panel 200 and a suction grill 300, which may be disposed on a lower end of the cabinet 110 to define an exterior of a bottom surface of the indoor device 100 and may be exposed in the ceiling when the indoor device 100 is installed. A heat exchanger 140 that heat-exchanges with suctioned air, a blower fan 120 to forcibly suction and discharge indoor air, and an air guide 130 having a bellmouth shape to guide the suctioned air toward the blower fan 120 may be provided in the cabinet 110.

The panel 200 may be mounted on the lower end of the cabinet 110 and have an approximately rectangular shape when viewed from a lower side thereof. Also, the panel 200 may protrude outward from the lower end of the cabinet 110, so that a circumferential portion of the panel 200 may be in contact with the ceiling.

At least one discharge hole 210 that serves as an outlet, through which the air may be discharged from the cabinet 110, may be provided in the panel 200. A discharge hole 210 may be defined at a position corresponding to each side of the panel 200. Each discharge hole 210 may be defined along a longitudinal direction of each side of the panel 200. Each discharge hole 210 each may be opened or closed by a vane 220 mounted on the panel 200.

The suction grill 300 may be mounted on or at a central portion of the panel 200. The suction grill 300 may define an exterior of a bottom surface of the indoor device 100. The suction grill 300 may provide a passage for air introduced into the indoor device 100. At least a portion of the suction grill 300 may have a grill or lattice shape so that the indoor air is smoothly introduced.

Hereinafter, structures of the panel 200 and the suction grill 300 according to embodiment will be described in detail hereinbelow.

Figure 4:
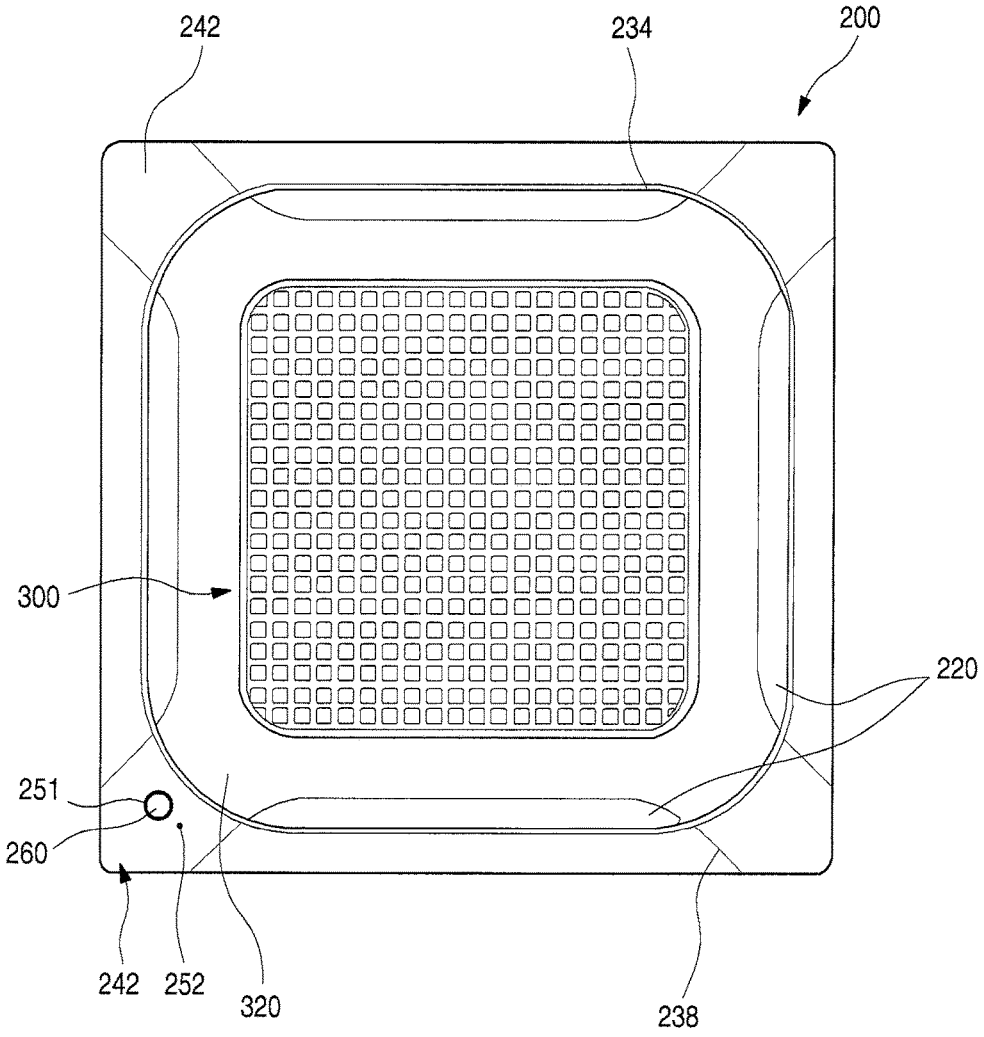
FIG. 4 is a bottom view of the indoor device for an air conditioner of FIG. 3.
Figure 5:
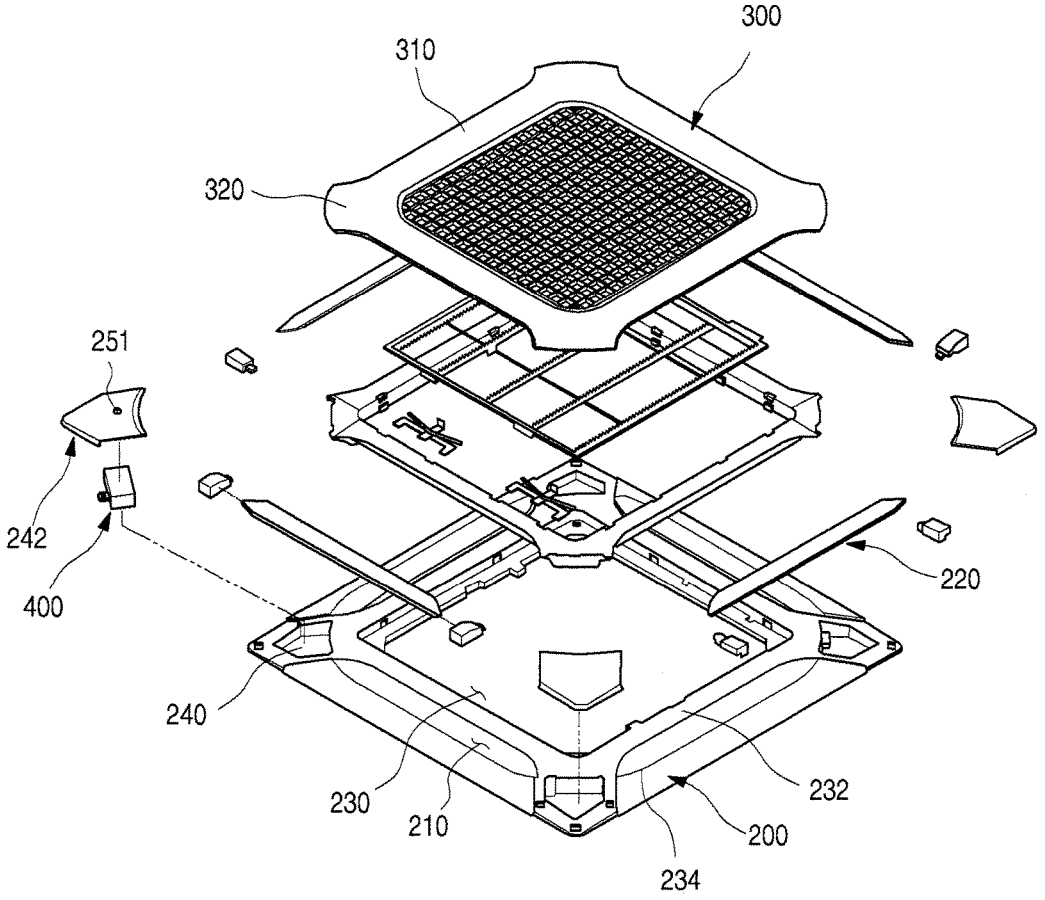
FIG. 5 is an exploded perspective view of a main portion of the indoor device for an air conditioner of FIG. 3.
Figure 6:
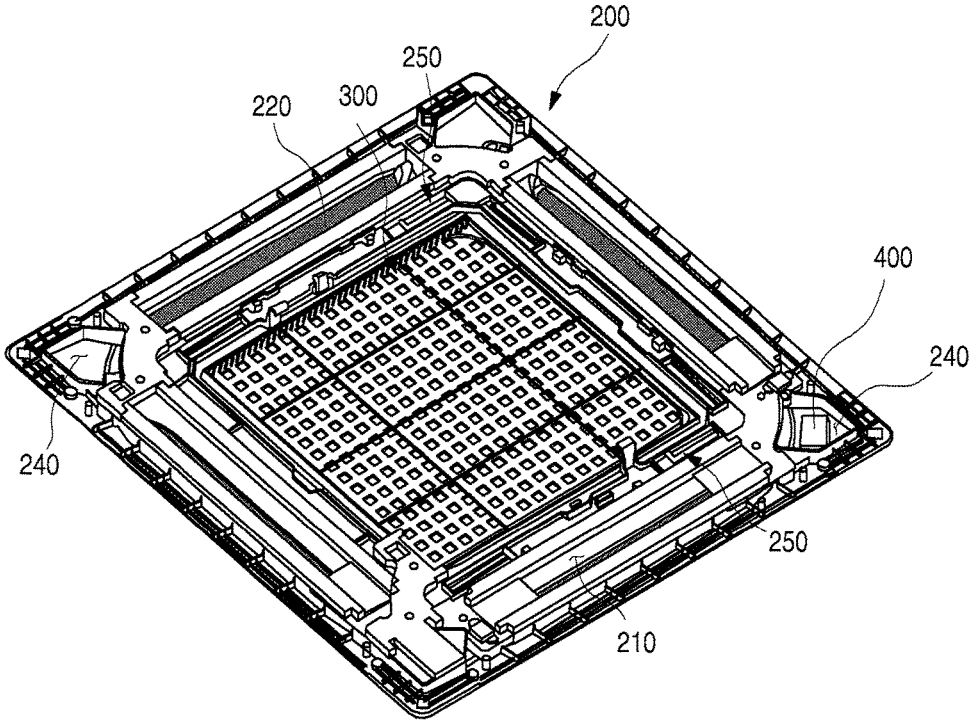
FIG. 6 is a perspective view illustrating a state in which a panel and a suction grill of the indoor device for an air conditioner of FIG. 3 are assembled with each other, when viewed from an upper side.

FIG. 4 is a bottom view of the indoor device for an air conditioner of FIG. 3. FIG. 5 is an exploded perspective view illustrating a main portion of the indoor device for an air conditioner of FIG. 3. FIG. 6 is a perspective view illustrating a state in which a panel and a suction grill of the indoor device for an air conditioner of FIG. 3 are assembled with each other, when viewed from an upper side.

As illustrated in the drawings, the panel 200 may have an approximately rectangular plate shape. A suction hole 230 may be provided in a central portion of the panel 200. The suction hole 230 may be configured to suction in the indoor air. The suction hole 230 may have a square shape and a size slightly less than a size of the suction grill 300.

The discharge hole(s) 210 may be defined outside of the suction hole 230. The discharge hole(s) 210 may be provided at each of four sides. Both ends of each discharge hole 210 may have a curved shape having a width that gradually decreases towards ends thereof.

A grill seat 232 may be disposed outside of the suction hole 230. The grill seat 232 may be stepped to support the suction grill 300. A connection member 250 that connects the panel 200 to the suction grill 300 to open or close the suction grill 300 may be seated on the grill seat 232.

The suction grill 300 may be mounted on the grill seat 232. In a state in which the suction grill 300 is mounted, a bottom surface of the panel 200 and a bottom surface of the suction grill 300 may be disposed on a same plane to provide a sense of unity.

A concave portion 310 may be defined in each of the sides of the suction grill 300. The concave 310 may be disposed at a same position as an inner line of the discharge hole 210. Also, in a state in which the suction grill 300 is mounted, as inner line of the discharge hole 210 and the concave portion 310 may have a same shape. That is, the concave portion 310 may have rounded ends or edges. The concave portion 310 may have a curvature corresponding to shapes of the discharge hole 210 and the vane 220.

Thus, if the suction grill 300 is closed, an inner line of the vane 220 and an end or edge of the suction grill 300 may be adjacent to each other at a same distance. Thus, the suction grill 300 and the panel 200 may provide a sense of unity.

A protrusion 320 may be disposed on each of the four edges of the suction grill 300. Each protrusion 320 may further protrude from the concave portion 310 to define a region between concave portions 310. Each protrusion 320 may be disposed between discharge holes 210 when the suction grill 300 is mounted. Each protrusion 320 may have an end that is rounded at a same curvature as that of the rounded groove 234. Thus, in a state in which the suction grill 300 is mounted, a circumference defined by the suction grill 300 and the vane 220 may have a same shape as the rounded groove 234.

The protrusion 320 may have a same width as a corner cover 242, which will be described hereinbelow. A side groove 238 defined along the protrusion 320 may extend up to an end or edge of the panel 200 along both sides of the corner cover 250. Also, the side groove 238 may be connected to the concave portion 310 of the suction grill 300 and the inner line of the vane 220.

Thus, in a state in which the indoor device 100 is installed, when viewed from a lower side of the indoor device 100, the rounded groove 234 may be defined in a center, and the side grooves 238 may be defined in each of four sides. Also, the shapes of the suction grill 300, the discharge hole 210, and the vane 220 may be defined by the rounded groove 234 and the side grooves 238.

A circumference of the grill seat 232 may have a closed loop shape that generally defines an outer line of the discharge hole 210. The rounded groove 234 may be defined around the grill seat 232 in a state in which the suction grill 300 is mounted. The rounded groove 234 may have a square shape having four rounded edges. Also, each of the edges of the rounded groove 234 may define a line corresponding to an end of a production of the suction grill 300 so that vanes 220 of the discharge hole(s) 210, the suction grill 300, and the panel 200 may provide a sense of unity on the whole. Also, the rounded groove 234 may have a predetermined rounded or inclined section so that the discharged air does not flow along the panel 200, thereby preventing the ceiling from being wetted or contaminated by the air discharged from the discharge hole(s) 210.

An inspection hole 240 may be provided in or at each of the four edges of the panel 200. The inspection hole 240 may provide a space to fix and install the panel 200. The inspection hole 240 may be opened or closed by the corner cover 242 so as to receive service to electronic components mounted on a back surface of the panel 200 or confirm an operation of the indoor device 100. An inspection hole 240 and a corner cover 242 may be disposed on each of the four edges of the panel 200 or be disposed on at least one of the four edges.

A controller 400, which may display an operation state of the indoor device 100 and receive a user's manipulation by using a remote controller, may be disposed on or in one inspection hole 240 of the four inspection holes 240 and the corner cover 242. Also, an installation hole 251, through which a receiving window 260, one component of the controller 400, may be exposed, and a reset hole 252 to initialize an operation state of the indoor device 1 may be defined in the corner cover 242.

An end of the corner cover 242 may be disposed to face an end of the protrusion 320 of the suction grill 300 with respect to the rounded groove 234 as a boundary. The corner cover 242 and the protrusion 320 may have lines corresponding to the rounded groove 234 to realize an exterior having a sensor of unity on the whole.

Figure 7:
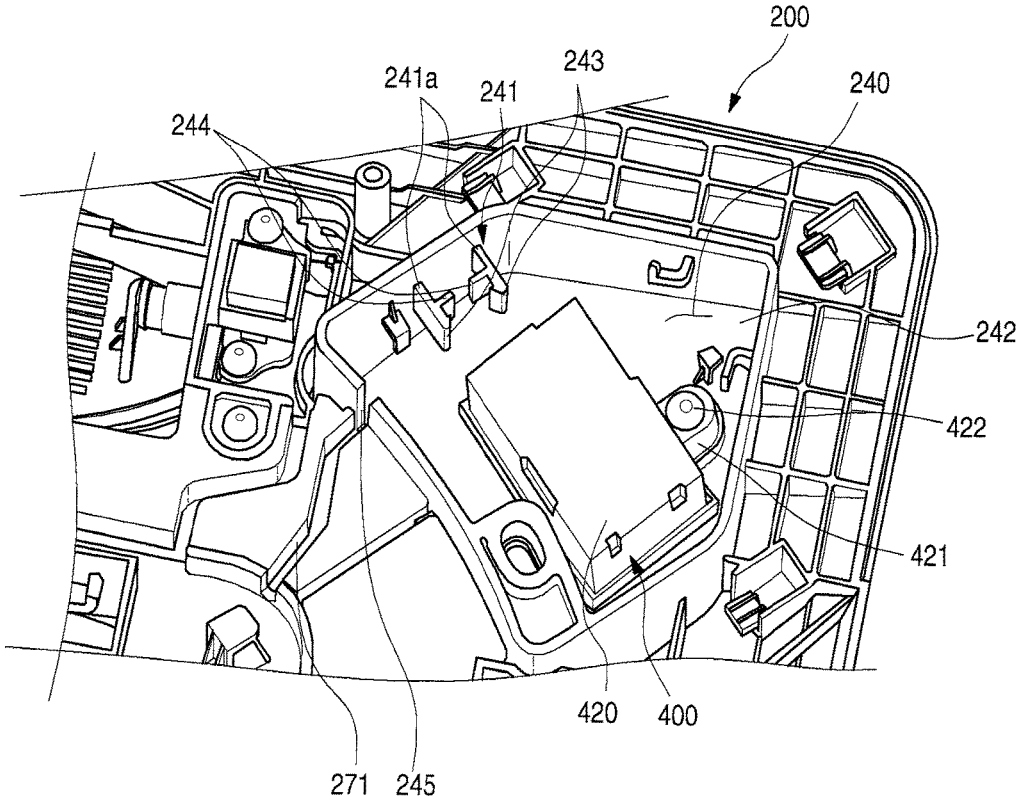
FIG. 7 is a partial view illustrating a state in which a controller of the indoor device for an air conditioner of FIG. 3 is mounted, when viewed from an upper side.
Figure 8:
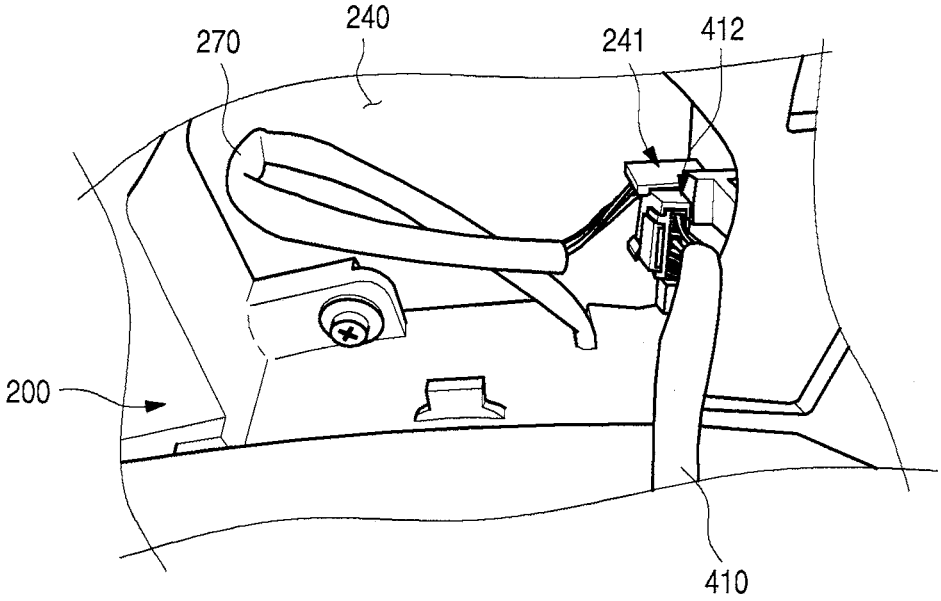
FIG. 8 is a partial view of a state in which a cable and connector connected to the controller are mounted according to embodiments.

FIG. 7 is a partial view illustrating a state in which a controller of the indoor device for an air conditioner of FIG. 3 is mounted, when viewed from an upper side. FIG. 8 is a partial view illustrating a state in which a cable and connector connected to the controller are mounted according to embodiments.

As illustrated in the drawings, the controller 400 may be mounted on a top surface of the panel 200. When the corner cover 242 is mounted on the panel 200, the controller 400 may be disposed inside the inspection hole 240. The controller 400 may be mounted on a case mount 253 disposed on a bottom surface of the corner cover 242, and the case mount 253 may have a space defined by a circumference 254 that protrudes from the bottom surface of the corner cover 242. The circumference 254 may have a shape corresponding to an exterior of the controller 400 so that the controller 400 may be seated inside the case mount 253. The installation hole 251 and the reset hole 252 may be defined inside the case mount 253.

The controller 400 may be electrically connected to electronic components (not shown), such as a fan motor, a motor, and a valve, for example, which may be in the indoor device 1, by electric wires 270 and 410. The electric wires 270 and 410 may be connected to each other by a connector. In more detail, the electric wires 270 and 410 may include a controller-side wire 410 that leads from the controller 400 and an electronic component-side wire 270 that leads from the electronic components. The controller-side wire 410 and the electrical electronic-side wire 270 may be connected to each other by a connector 412. The connector 412 may be provided with male and female connectors to connect the electronic components to the controller 400 so that electronic components and the controller 400 are operable.

A connector fixing portion 241, to which the connector 412 may be fixed, may be disposed on an inner wall of the inspection hole 240. The connector fixing portion 241 may be provided with a pair of fixing ribs 241*a* that protrude inward from the inspection hole 240. A hook 243 may be disposed on an end of each of the fixing ribs 241*a*, and a fixing end 244 may protrude between the hook 243 and the wall of the inspection hole 240.

A distance between the fixing end 244 and the hook 243 may correspond to a thickness of the connector 412. Thus, the connector 412 may be accommodated into a space between the fixing end 244 and the hook 243. The connector 412 may have a hook fixing structure.

When the connector 412 is mounted on the connector fixing portion 241, the connector 412 may be disposed in a direction in which the female and male connectors are coupled to each other. Thus, the connector 412 may be fixed to or at a position which is spaced apart from the wall.

As a result, even though frost may form in the inspection hole, the frost formed on the wall of the inspection hole 240 may not affect the connector 412. Also, even though water drops may drop into the connector 412, as the connector stands up in a coupling direction, the water drops may flow downward along the connector 412. Thus, the connector 412 may not be affected by the frost formation.

One side or wall of the inspection hole 240 may be cut to form an electric wire entrance 245, through which the electronic component-side wire 270 may be accessible, and an electric wire guide 271 connected to the electric wire entrance 245 may be recessed in the panel 200. Thus, the electronic component-side wire 270 may pass through the electric wire entrance 245 in a state in which the electronic component-side wire 270 is inserted into the electric wire guide 271, and then, may be introduced into the inspection hole 240, thereby being fixed to the connector fixing portion 241. In a state in which the connector 412 is fixed and mounted on the connector fixing portion 241, when the corner cover 242 is mounted on the panel 200, interference between the electric wires 270 and 410 may be minimized. Also, when the corner cover 242 is opened to separate the connector 412 from the panel 200, a fixed state of the connector 412 may be maintained to prevent the female and male connectors from being separated from each other due to the separation of a pin of the connector 412.

In the controller 400, a case 420, which may define an exterior thereof, may be coupled and fixed to the corner cover 242 by a coupling member 422, such as a screw. A plurality of components of the controller 400 may be mounted inside the controller 400.

Figure 9:
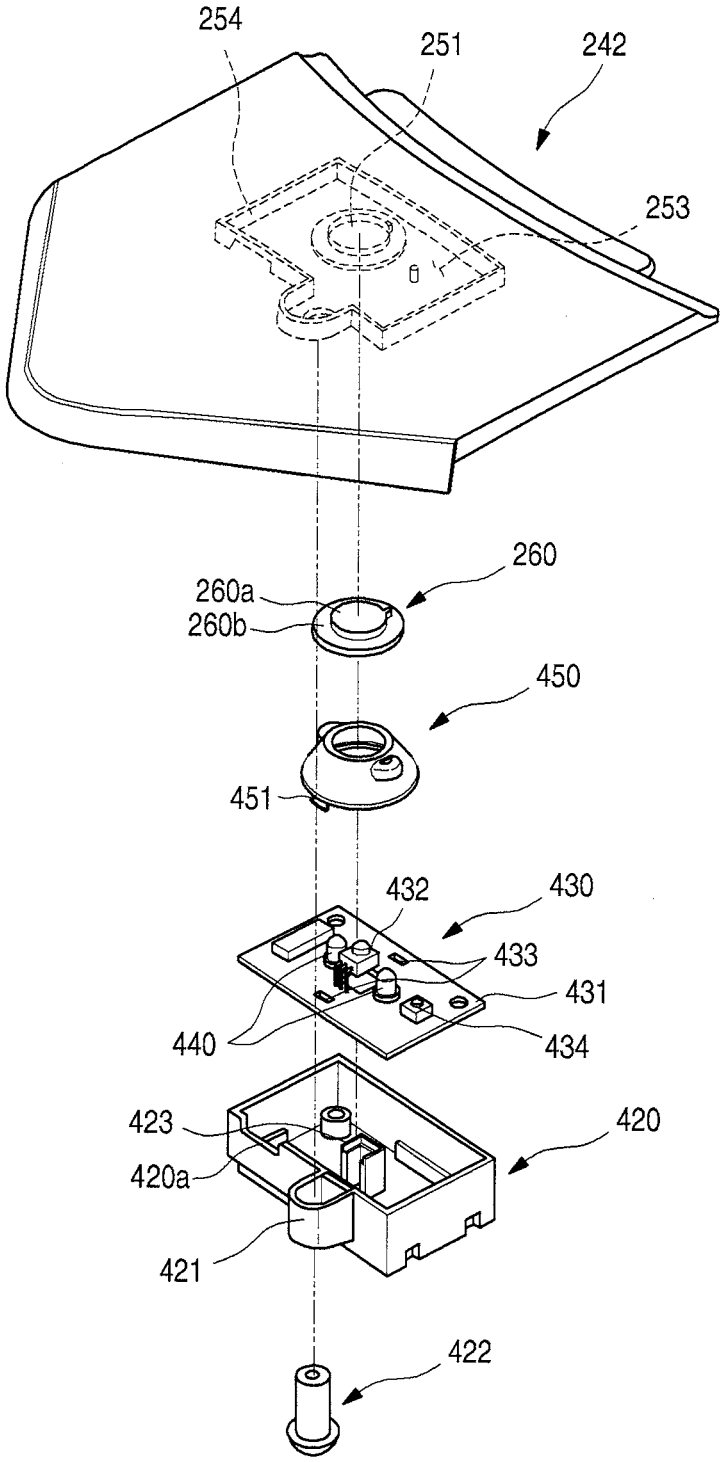
FIG. 9 is an exploded perspective view illustrating a coupled structure of the controller of FIG. 7.
Figure 10:
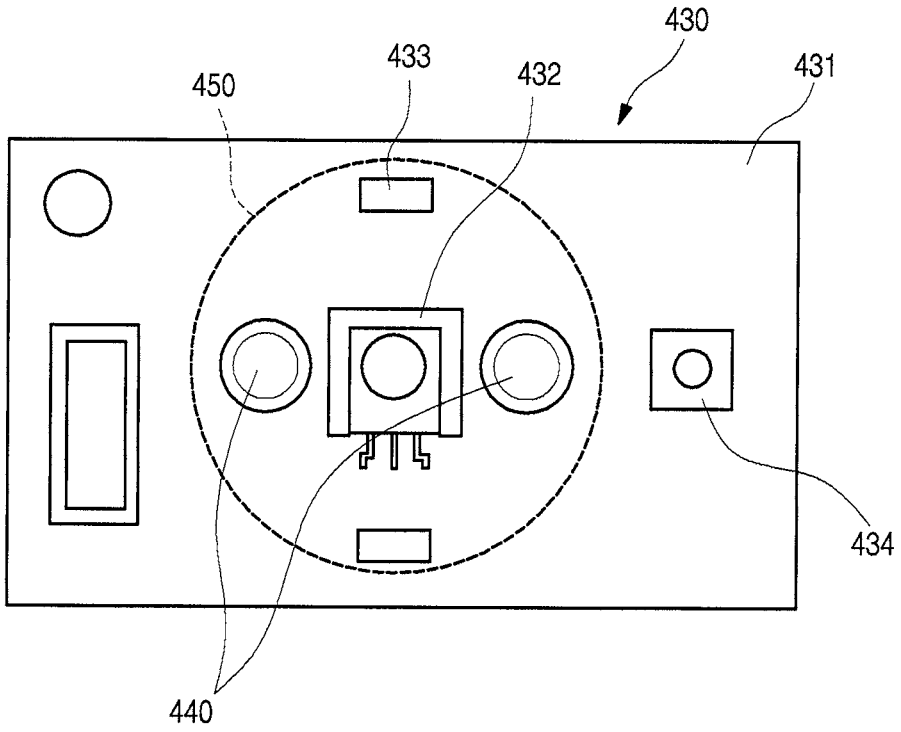
FIG. 10 is a schematic plan view illustrating an arrangement of the controller of FIG. 7.

FIG. 9 is an exploded perspective view illustrating a coupled structure of the controller of FIG. 7. FIG. 10 is a schematic plan view illustrating an arrangement of the controller of FIG. 7.

Referring to FIGS. 9 and 10, the controller 400 may include the case 420, a board assembly 430 mounted inside the case 420 and on which one or more LEDs 440 and a receiver 432 may be mounted, a guide 450 to block light of the one or more LEDs 440, and the receiver window 260 to cover the installation hole 251.

The case 420 may have an opened top surface to provide a space in which the board assembly 430 may be accommodated. The case 420 may be inserted into the case mount 253 disposed on a bottom surface of the corner cover 242 so that the circumference 254 is closely attached along an outer-periphery of the case 420.

A support 423 that supports the board assembly 430 may be disposed on an inner surface of the case 420, and an electric wire entrance 420*a*, through which the controller-side wire 410 may be accessed, may be open. A coupling member coupling portion 421, to which the coupling member 422 may be coupled, may be disposed on one side of the case 420. The coupling member 422 may pass through the coupling member coupling portion 421, and then, may be coupled to the corner cover 242.

The board assembly 430 may include a PCB 431, the receiver 432 mounted on the PCB 431 to receive a manipulation signal of a remote controller, and the one or more LED 440 mounted on the PCB 431 outside or at a periphery of the receiver 432. The one or more LEDs 440 may be turned on/off to display an operation state of the indoor device 1. That is, the operation state of the indoor device 1 may be displayed by turning on/off of the one or more LED 440.

The one or more LED 440 may be provided as a single color LED to allow the LED 440 having a color corresponding to the operation state of the indoor device 1 to be turned on. Alternatively, LEDs 440 may be provided as a three color LED. The one or more LEDs 440 may be turned on/off with a color corresponding to the operation state of the indoor device 1.

Further, the one or more LEDs 440 may be disposed symmetrical to each other with respect to the receiver 432. The one or more LEDs 440 may be disposed outside or at a periphery of the installation hole 251 to prevent a reception rate of the receiver 432 from being reduced. Furthermore, the one or more LEDs 440 and the receiver 432 may be disposed inside the guide member 450.

The guide member 450 may be attached between the PCB 431 and the corner cover 242 and have a cylindrical shape with opened upper and lower ends. The opened lower end of the guide member 450 may be fixed and mounted on the PCB 431 by a mount protrusion 451 and a mount groove 433, for example. Also, the upper end of the guide member 450 may contact a bottom surface of the corner cover 242.

The opened upper surface of the guide member 450 may have a size corresponding to or somewhat greater than a size of the installation hole 251. The receiver window 260 may be mounted on the installation hole 251. Thus, an inner space of the guide member 450 may be sealed to prevent light irradiated from the one or more LEDs 440 disposed inside the guide member 450 from leaking to the outside and irradiate the light to the outside through the receiver window 260.

The receiver window 260 may be formed of a light transmission material so that the light emitted from the one or more LEDs 440 may be emitted to the outside, and the manipulation signal of the remote controller may be received into the receiver 432. The receiver window 260 may include an exposed portion 260*a* having a shape corresponding to a shape of the installation hole 251, and a stepped portion 260*b*, which is stepped to protrude outward from the exposed portion 260*a*. Also, an outside of the installation hole 251 may be stepped to correspond to the stepped portion 260*b* so that the receiver window 260 may be mounted on the corner cover 242.

A reset device 434 may be mounted on the PCB 431. The reset device 434 may initialize a set-up operation of the indoor device 1 and may include a button type switch. The reset device 434 may be disposed directly under the reset hole 252 defined in the corner cover 242. Thus, a user may manipulate the reset device 434 by using a separate member, such as a pin, through the reset hole 252.

The receiver 432 may be disposed directly under a center of the receiver window 260. For example, the receiver 432 may be disposed at a position at which the manipulation signal of the remote controller is capable of being easily received when the remote controller is manipulated from the outside. That is, the receiver 432 may be disposed at a central portion of the guide member 450, and the one or more LEDs 440 may be disposed at positions corresponding to both sides of the receiver 432.

The receiver 432 may extend further upward from the PCB 431 than the one or more LEDs 440 to more easily receive the manipulation signal of the remote controller. Also, the one or more LEDs 440 may emit toward both sides to offset shade areas generated by the receiver 432.

Hereinafter, an operation of the air conditioner having the above-described structure according to embodiments will be described.

Figure 11:
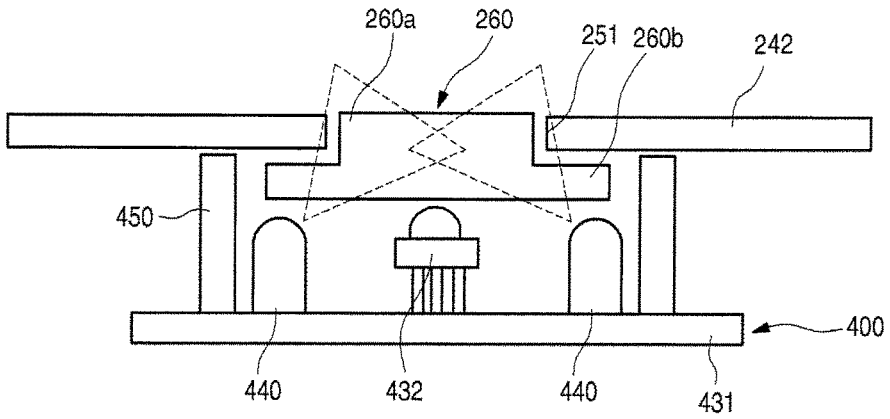
FIG. 11 is a schematic view illustrating an operation state of the controller of FIG. 7.

FIG. 11 is a schematic view illustrating an operation state of the controller of FIG. 7. As illustrated in the drawings, when a user manipulates a remote controller to manipulate the indoor device 1, a manipulation signal may be received into the receiver 432. The manipulation signal received into the receiver 432 may be transmitted into the indoor device 1 and various electronic components of the air conditioner to allow the indoor device 1 and the electronic components to operate.

The one or more LEDs 440 may operate according to an operation state of the indoor device 1. Also, according to the operation of the one or more LEDs 440, light having a preset color may be emitted to the outside through the receiver window 260.

If the one or more LEDs 440 is provided as a three-color LED, when the indoor device 1 performs a cooling or heating operation, the one or more LEDs 440 may emit green light, for example. When the indoor device 1 performs sterilization and air cleaning operations in addition to the cooling or heating operation, the one or more LEDs 440 may emit yellow-green light, for example. When the indoor device 1 performs the sterilization and air cleaning operations without performing the cooling or heating operation, the one or more LEDs 440 may emit yellow light, for example.

Of course, the above-described operations are merely examples for explanation and comprehension. For example, light having variously preset colors may be irradiated according to an abnormal operation of the indoor device 1, filter exchange, and operation modes, for example. Also, the colors provided by the one or more LED 440 may be selected according to functions, installed environments, or a user's tastes, for example.

Also, light emitted toward both sides of the receiver 432 may be irradiated toward the receiver window 260. The light emitted from the one or more LEDs 440 may be uniformly irradiated toward both sides of the receiver 432 to prevent the shade areas due to the receiver 432 from occurring and uniformly irradiate light through the receiver window 260.

Thus, a user may manipulate the indoor device 1 and the air conditioner through the remote controller and easily confirm the operation state due to the user's manipulation through the receiver window 260. The indoor device according to this embodiment may be identically applied to other embodiments in addition to the foregoing embodiment.

An indoor device for an air conditioner according to additional embodiments may be different from each other in inner components of a controller. Also, as other components except for the controller may be the same as those of the previous embodiment, their detailed descriptions have been omitted.

Hereinafter, an indoor device for an air conditioner according to additional embodiments will be described in more detail with reference to the accompanying drawings.

Figure 12:
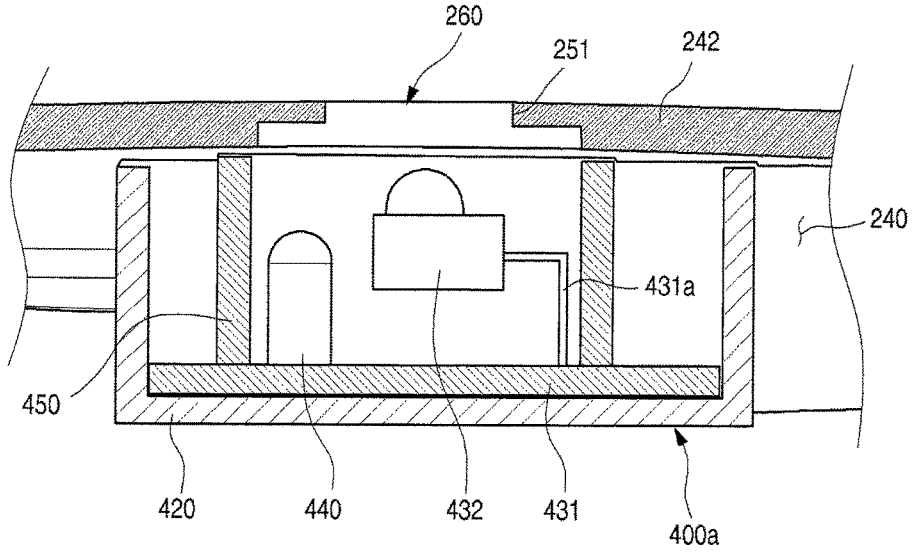
FIG. 12 is a schematic view of a controller in an indoor device for an air conditioner according to another embodiment.

FIG. 12 is a schematic view of a controller in an indoor device for an air conditioner according to another embodiment. Referring to FIG. 12, a controller 400*a* according to this embodiment may be mounted on corner cover 242 to cover inspection hole 240. Receiver window 260 of the controller 400*a* may be mounted on installation hole 251 of the corner cover 242 to allow a transmitting/receiving signal of a remote controller and light emitted from LED 440 to pass therethrough.

PCB 431 may be mounted inside case 420 of the controller 400*a*, and receiver 432, and the LED 440 may be disposed on the PCB 432. Guide 450 may be disposed outside the LED 440 and the receiver 432.

Thus, the LED 440 and the receiver 432 disposed inside the guide 450 may be disposed under one receiver window 260. A manipulation signal of a remote controller may be received through the receiver window 260, and light having a preset color according to operation states of the indoor device 1 and the air conditioner may be emitted through the LED 441.

Here, only one LED 440 may be disposed outside or at a periphery of the receiver 432, and may be provided as a three color LED or a four color LED. Thus, light having a preset color may be irradiated through the receiver window 260 according to the operation state of the indoor device 1.

Also, an upper end of the LED 440 may be disposed at a position lower than a portion of an upper end of the receiver 432, and may also be disposed outside of or not at a center of the receiver window 260 to maximally increase a reception rate of the receiver 432. Moreover, the receiver 432 may be disposed above the PCB 431 in a state in which the receiver 432 is spaced apart from the PCB 431 by a rod 431*a* that connects the receiver 432 to the PCB 431.

Figure 13:
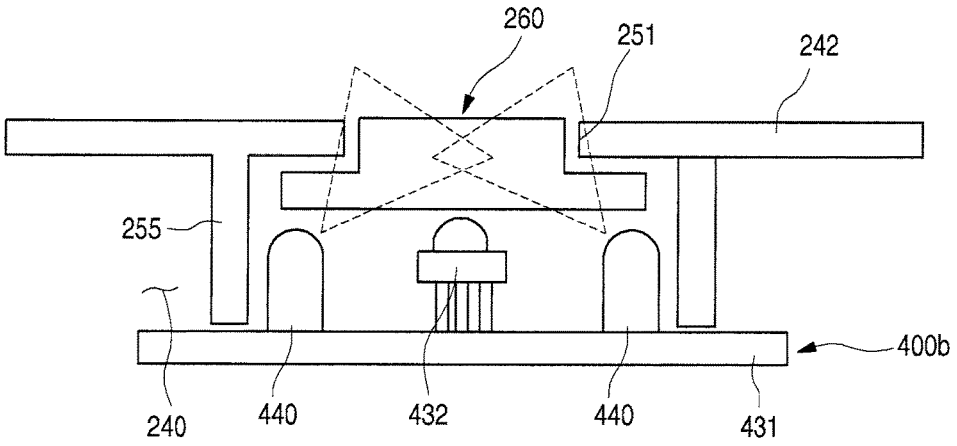
FIG. 13 is a schematic view of a controller in an indoor device for an air conditioner according to still another embodiment.

FIG. 13 is a schematic view of a controller in an indoor device for an air conditioner according to still another embodiment. Referring to FIG. 13, a controller 400*b* according to this embodiment may include PCB 431. Receiver 432 may be disposed on or at a center of the PCB 431, and LEDs 440 may be disposed on or at each side of the receiver 432. The LEDs 440 may be disposed on each of both lateral sides, and may also be disposed inside a guide 255 that extends downward from a bottom surface of corner cover 242. The guide 255 may be integrated with the corner cover 242 when the corner cover 242 is molded. Also, the guide 255 may extend downward from the outside or a periphery of an installation hole 251 defined in the corner cover 242.

Thus, the LED 440*s*, the receiver 432, and the receiver window 260 may be disposed inside the guide 255. The LEDs 440 may include a plurality of LEDs 440, as shown in FIG. 13, or only one LED 440 provided at the outside or a periphery of the receiver 432.

Figure 14:
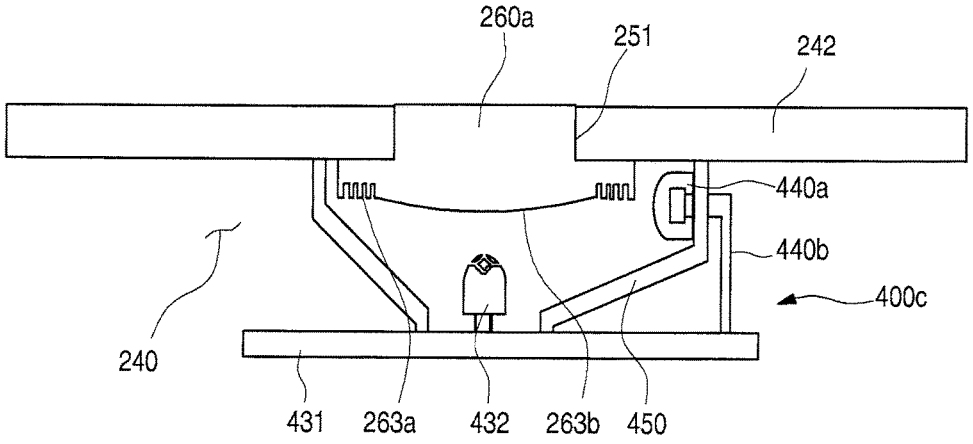
FIG. 14 is a schematic view of a controller in an indoor device for an air conditioner according to still another embodiment.

FIG. 14 is a schematic view of a controller in an indoor device for an air conditioner according to another embodiment. Referring to FIG. 14, a controller 400*c* according to this embodiment may be disposed under corner cover 242. An installation hole 251, in which a receiver window 260*a* may be mounted, may be defined in the corner cover 242.

PCB 431 of controller 400*c* may include receiver 432, and guide 450 disposed between the PCB 431 and the corner cover 242. The guide 450 may provide a space between the PCB 431 and the corner cover 242, and the receiver 423 may be disposed inside the guide 450. The receiver 432 may be disposed at a central portion of the receiver window 260*a*.

Also, one or more LED 440*a* may be disposed on the guide 450. The one or more LED 440*a* may protrude from an inside of the guide 450 and be mounted on a side surface of the guide 450. A rod 440*b* of the one or more LED 440*a* may be connected to the PCB 431. The rod 440*b* may be bent to connect to the PCB 431, which may be operably spaced apart from the one or more LED 440*a*. Thus, the one or more LED 440*a* may be disposed in a direction in which the one or more LED 440*a* and the receiver 432 cross each other.

The one or more LED 440*a* may be configured to irradiate light from a side of the receiver window 260*a* toward the receiver window 260*a* and may not interfere with reception of an operation signal into the receiver 432. A pattern 263*a* may be disposed around a bottom surface of the receiver window 260*a* to allow the light emitted from the one or more LED 440*a* in a lateral direction thereof to be uniformly transmitted through an entire surface of the receiver window 260*a*.

A central portion 263*b* of a bottom surface of the receiver window 260*a* may have a convex shape to effectively guide external light toward the receiver window 260*a*. Thus, an amount of light passing through the receiver window 260*a* may increase so that the receiver window 260*a* is very bright.

Only one LED 440*a* may be disposed on the side surface of the guide 450. Alternatively, a plurality of LEDs 440*a* may be arranged at a predetermined distance from each other. If only one LED 440*a* is provided, a LED 440*a*, which is capable of selectively emitting light having various colors, may be used. Also, if a plurality of LEDs 440 is provided, each LED 440*a* may be a single color LED 440*a*. Also, if the plurality of LEDs 440*a* is provided, the LEDs 440*a* may be disposed to face each other with respect to the receiver 432.

Figure 15:
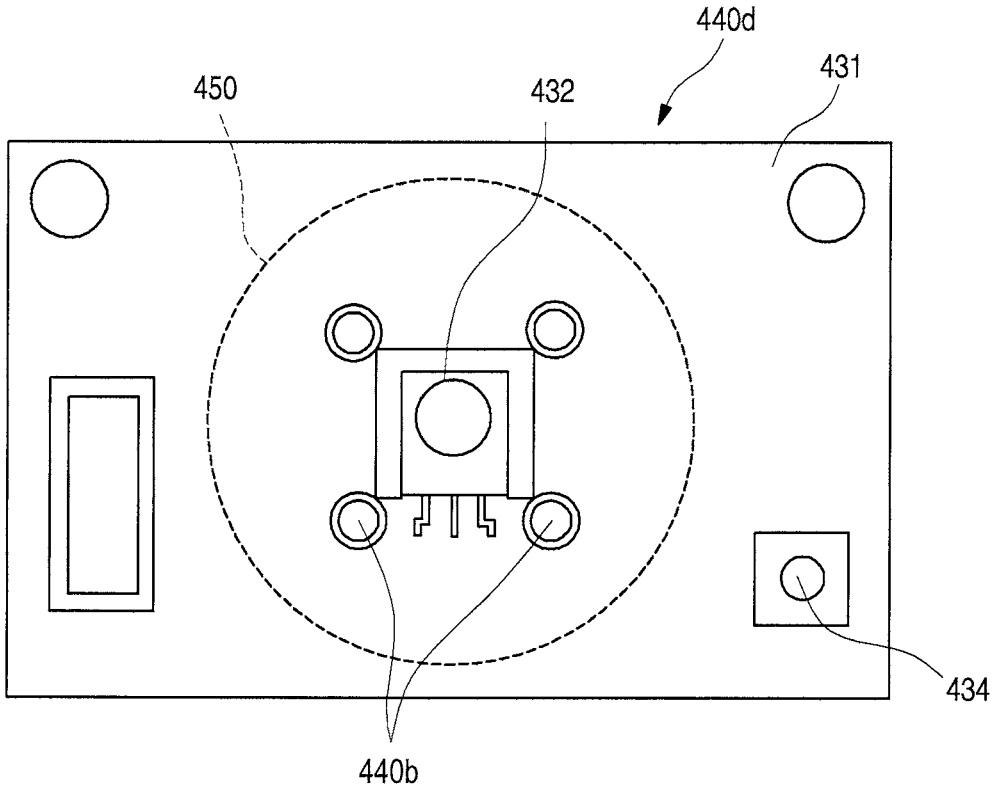
FIG. 15 is a schematic view of a controller in an indoor device for an air conditioner according to still another embodiment.

FIG. 15 is a schematic view of a controller in an indoor device for an air conditioner according to another embodiment. Referring to FIG. 15, a controller 400*d* according to this embodiment may include receiver 432, one or more LED 440*b*, and a reset device 434, which may be disposed on PCB 431 of controller 440*d*.

The receiver 432 and the one or more LED 440*b* may be disposed inside guide 450, and the reset device 434 may be disposed outside or at a periphery of the guide member 450. The receiver 432 may be disposed at a center of the guide 450, and the one or more LED 440*b* may be disposed on each of both sides of the receiver 432.

The one or more LED 440*b* may be provided as a pair of LEDs 440*b* on each of both lateral sides, and thus, a total of four LEDs 440*b* may be provided. The LEDs 440*b* may be disposed at a same distance from the receiver 432 and also may be disposed at a same distance from each other. The four LEDs 440*b* may be, respectively, provided as single color LEDs to emit light having colors different from each other. Alternatively, the LEDs 440*b* may be provided as a LED which capable of selectively emitting light having various colors. Also, brightness may be adjusted according to a number of LEDs 440*b*.

Figure 16:
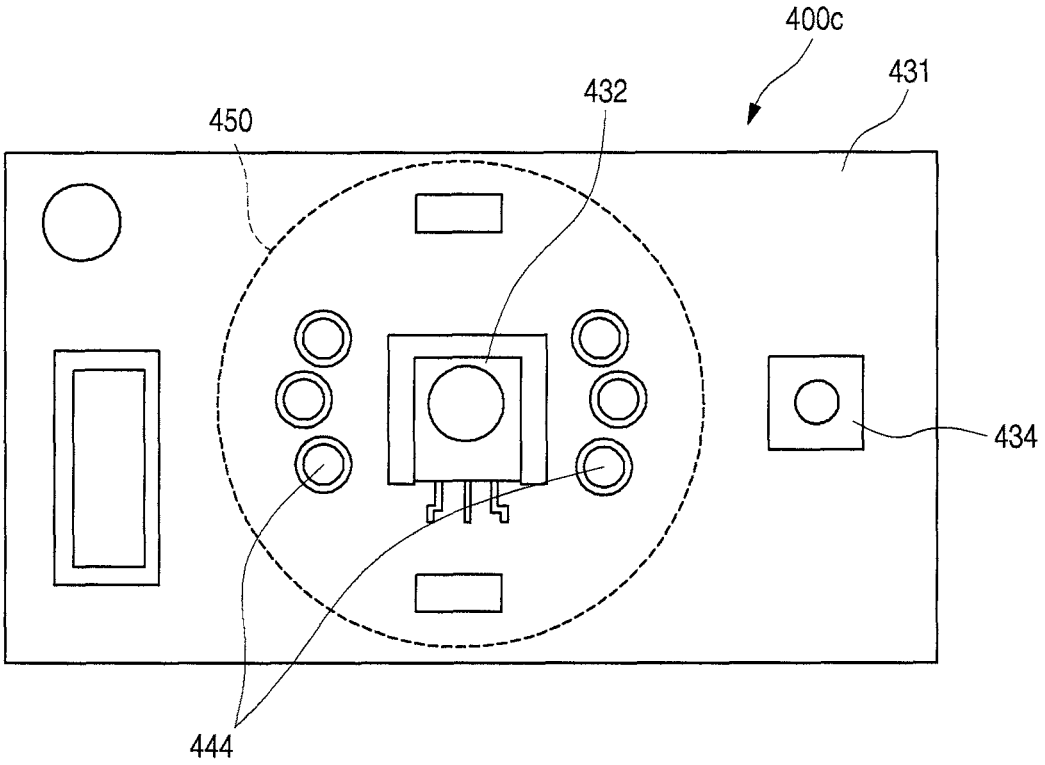
FIG. 16 is a schematic view of a controller in an indoor device for an air conditioner according to still another embodiment.

FIG. 16 is a schematic view of a controller in an indoor device for an air conditioner according to still another embodiment. Referring to FIG. 16, a controller 400*e* according to this embodiment may include a receiver 432, one or more LED 440*c*, and a reset device 434, which may be disposed on PCB 431 of the controller 400*c*.

The receiver 432 and the one or more LEDs 440*c* may be disposed inside guide 450, and the reset device 434 may be disposed outside or at a periphery of the guide 450. Also, the receiver 432 may be disposed at a center of the guide 450, and the one or more LEDs 440*c* may be disposed on each of both sides of the receiver 432.

The one or more LEDs 440*c* may be provided as three LEDs on each of both lateral sides, and thus, a total of six LEDs 440*c* may be provided. The LEDs 440*c* may be disposed on both sides with respect to the receiver 432.

Also, the LEDs 440*c* may be disposed at a same distance from the receiver 432. Each of the LEDs 440*c* may be provided as a single color LED. The LEDs 440*c* disposed on each side may be provided as LEDs having colors different from each other, and the LEDs 440*c* disposed on each side may be provided as LEDs 440*c* having a same number of colors.

For example, the LEDs 440*c* disposed on one side may be provided as three LEDs, that is, green, red, and yellow LEDs. The LEDs 440*c* disposed on an opposite side may also be provided as three LEDs, that is, green, red, and yellow LEDs 444. The LEDs 440*c*, which are disposed on upper and lower ends, of the LEDs 444 may have a same color in facing diagonal directions. Also, a central LED may have a same color as a central LED disposed at an opposite side.

Components or features of the indoor device according to this embodiment may be identically applied to other embodiments in addition to the previous embodiments.

An indoor device for an air conditioner according to additional embodiments may be different from each other in shape of a receiver window mounted on the corner cover. Also, as other components except for the shape of the receiver window according to this embodiment may be the same as previous embodiments, their detailed descriptions have been omitted.

Hereinafter, an indoor device for an air conditioner according to additional embodiments will be described in more detail with reference to the accompanying drawings.

Figure 17:
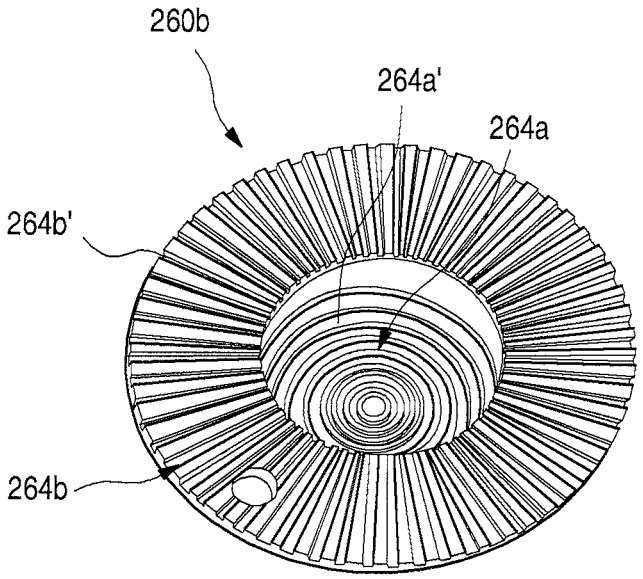
FIG. 17 is a perspective view illustrating a shape of a receiver window in an indoor device for an air conditioner according to an embodiment.

FIG. 17 is a perspective view illustrating a shape of a receiver window in an indoor device for an air conditioner according to an embodiment. Referring to FIG. 17, a first groove 264*a*' having a plurality of concentric circle shapes formed from a center of exposed portion 264*a* may be defined in an inner surface of the exposed portion 264*a* of receiver window 260*b* according to this embodiment. A second groove 264*b*' may be defined in a bottom surface of a stepped portion 264*b*.

The second groove 264*b*' may be radially defined outward from a center of the receiver window 260*b*. The second groove 264' may be provided as a plurality of grooves, and the plurality of second grooves 264' may be successively defined. A distance between the second grooves 264*b*' may be adjusted as necessary, and also, the second grooves 264*b*' may be uniformly distributed in an entire surface of the stepped portion 264*b*.

The first and second grooves 264*a*' and 264*b*' may refract or reflect light emitted from LED 440 to diffuse the light, thereby preventing the light from being locally irradiated onto the receiver window 260*b*. Thus, the receiver window 260*b* may have uniform brightness on the whole.

Figure 18:
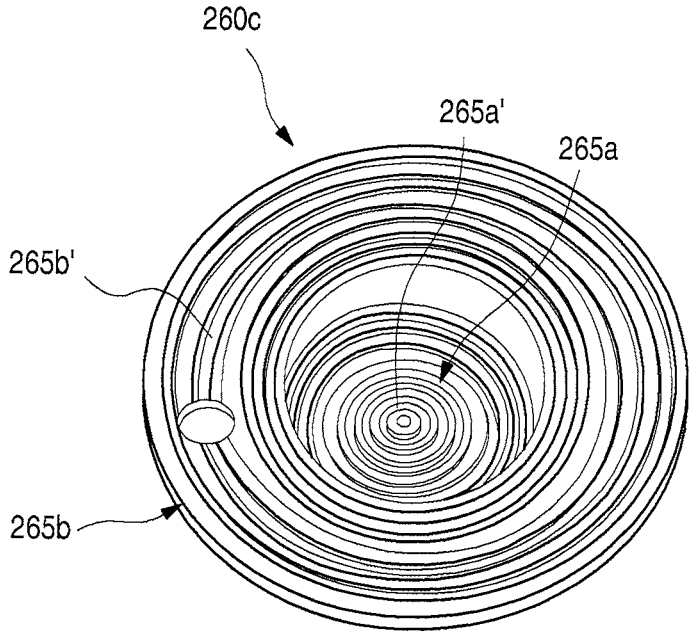
FIG. 18 is a perspective view illustrating a shape of a receiver window in an indoor device for an air conditioner according to another embodiment.

FIG. 18 is a perspective view illustrating a shape of a receiver window in an indoor device for an air conditioner according to another embodiment. Referring to FIG. 18, a first groove 265*a*' having a plurality of concentric circle shapes formed from a center of exposed portion 265*a* may be defined in an inner surface of exposed portion 265*a* of receiver 260*b* according to this embodiment. Also, a second groove 265*b*' may be defined in a bottom surface of stepped portion 265*b*.

Like the first groove 265*a*', the second groove 265*b*' may have a plurality of concentric circle shapes with respect to a center of the receiver 260*b*. A distance between the plurality of second grooves 265*b*' may be adjusted as necessary, and also, the plurality of second grooves 256*b*' may be uniformly distributed in an entire surface of the stepped portion 265*b*.

The first and second grooves 265*a*' and 265*b*' may refract or reflect light emitted from LED 440 to diffuse the light, thereby preventing the light from being locally irradiated onto the receiver window 260*b*. Thus, the receiver window 260*b* may have uniform brightness on the whole.

Figure 19:
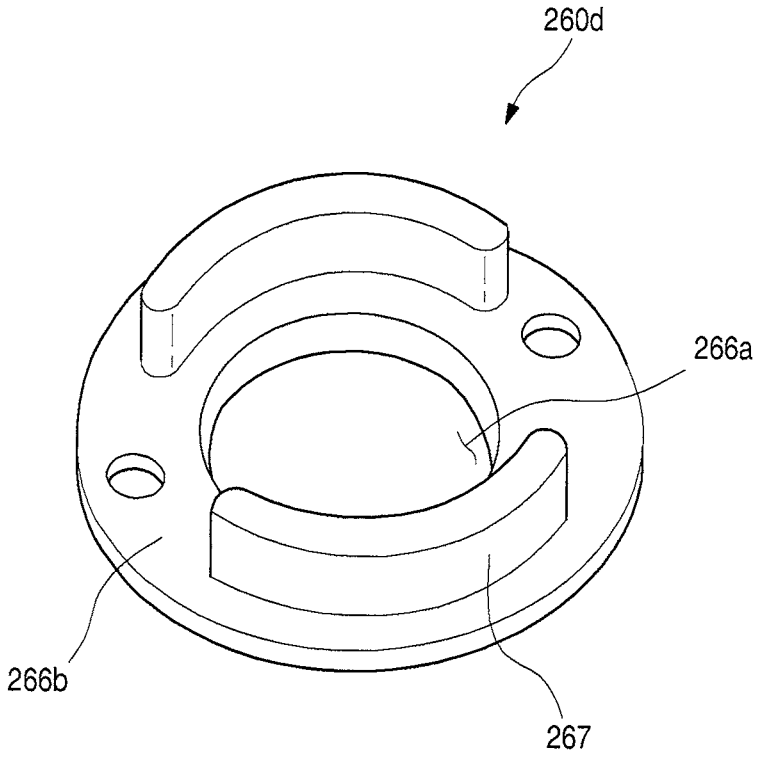
FIG. 19 is a perspective view illustrating a shape of a receiver window in an indoor device for an air conditioner according to still another embodiment.

FIG. 19 is a perspective view illustrating a shape of a receiver window in an indoor device for an air conditioner according to another embodiment. Referring to FIG. 19, a receiver window 260*d* according to this embodiment may include exposed portion 266*a* and stepped portion 266*b*. An extension 267 may be disposed on a bottom surface of the stepped portion 266*b*. The extension portion 267 may extend downward from the bottom surface of the stepped portion 266*b* and may have a predetermined length. The extension 267 may be disposed on both lateral sides and be rounded at a curvature corresponding to a curvature of an outer surface of the receiver window 260*d*.

The extension 267 may extend up to a side of LED 440 so that light may be irradiated from the side of the LED 440 toward the extension 267. The LED 440 may be disposed on a side surface of the guide 450 to face the extension 267. If two extensions 267 are provided, the LED 440 may be provided in a same number as the extensions 267. That is, if one extension 267 is provided, only one LED 440 may be provided.

Thus, light emitted from the LED 440 may be diffused while passing through the extension 267 and uniformly distributed to pass through the exposed portion 266*a*, thereby preventing the light from being locally irradiated onto the receiving window 260*d*. Therefore, the receiver window 260*d* may have uniform brightness on the whole.

According to embodiments, a receiver to receive a manipulation signal of a remote controller and an LED that emits light having a preset color onto a receiver window according to an operation state of an indoor device may be provided inside the receiver window, which may be provided as a single component. Thus, as it is unnecessary to provide a part to receive a manipulation signal of a remote controller and a part to display the operation state of the indoor device, production costs and a number of processes may be significantly reduced. Also, an exposed portion may be minimized to realize a more simple and clear exterior.

Also, a controller including a receiver and an LED may be mounted on a corner cover to open or close an inspection hole of a panel, and a connector of an electric wire connected to the controller may be fixed to one side of the inspection hole in a state in which the connector is spaced apart from the inspection hole, to prevent the connector from being arbitrarily separated and to minimize an effect due to the frost formation. Also, the receiver may be disposed at a center of the receiver window, and the LED may emit light at the outside of the receiver window to prevent a reception rate of the receiver from being reduced.

Embodiments provide an indoor unit or device for an air conditioner, in which displaying of an operation state of the indoor unit and receiving of an operation signal of a remote controller may be performed through one window.

Embodiments disclosed herein provide an indoor unit or device for an air conditioner that may include a panel constituting at least one portion of a configuration of the indoor unit that is exposed to the outside; a receiving window mounted on an installation hole defined in the panel, the receiving window being formed of a light transmission material; a receiving part or receiver disposed under the receiving window to receive a manipulation signal of a remote controller that is manipulated from the outside; and an LED disposed on a side of the receiving part to emit light toward the receiving window, thereby displaying an operation state of the indoor unit to the outside. The receiving part may be disposed at a position that corresponds to a center of the receiving window, and the LED may be disposed outside the receiving window. The receiving part may be disposed at a position that is adjacent or closer to the receiving window than the LED.

The LED may be disposed on each of both left and right or lateral sides of the receiving part. The LED may emit light from a side of the receiving window toward a side end of the receiving window. The LED may emit light having three colors.

The LED may be provided in plurality, and the plurality of LEDs may be disposed at a same distance from the receiving part. The LEDs may emit light having colors different from each other.

A groove or pattern may be provided in an inner surface of the receiving window to diffuse the light emitted from the LED. An extension part or extension disposed at a position that corresponds to the LED and protruding along an extension line of the LED to disperse the light emitted from the LED may be further disposed on an inner surface of the receiving window.

Embodiments disclosed herein further provide an indoor unit or device for an air conditioner that may include a cabinet inserted into a ceiling in an indoor space; a panel mounted on a bottom surface of the cabinet to define an exterior that is exposed to the indoor space, the panel having a suction hole and a plurality of discharge holes; a suction grill that opens/closes the suction hole; an inspection hole defined between the plurality of discharge holes, the inspection hole being opened at an edge of the panel; a corner cover that opens/closes the inspection hole, the corner cover having a punched installation hole; a receiving window that covers the installation hole, the receiving window having light transmission; and a controller mounted inside the corner cover to receive a manipulation signal of an external remote controller through the installation hole and to irradiate light having various colors onto the receiving window, thereby displaying an operation state of the indoor unit to the outside.

A connector fixing part or portion to fix a connector that connects an electric wire that extends from the controller to an electric wire that extends from an electronic component within the indoor unit may be further disposed in the inspection hole. The connector may be mounted on the connector fixing part in a state in which the connector is spaced apart from a wall of the inspection hole. The connector may be mounted on the connector fixing part so that the electric wires are connected to each other in a vertical direction.

The controller may include a case fixed to the corner cover to define an exterior; a PCB mounted inside the case; a receiving part or receiver mounted on the PCB corresponding to the installation hole to receive the manipulation signal of the remote controller; and an LED mounted inside the receiving part to emit light to display the operation state of the indoor unit. The LED may be disposed outside the installation hole.

The LED may be provided in plurality. The plurality of LEDs may be disposed at a same distance from the receiving part.

A guide member may be mounted on the PCB so that the guide member may be closely attached between the PCB and the corner cover and provide a space to accommodate the receiving part and the LED. An opened top surface of the guide member may have a size corresponding to or greater than a size of the installation hole.

The LED may be mounted on a side surface of the guide member and may be installed in a direction crossing the receiving part. A reset hole may be defined to pass through a side of the corner cover, and a reset device to initialize a set-up state of the indoor unit may be disposed on a side of the PCB corresponding to the reset hole.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An indoor device for an air conditioner, the indoor device comprising:

a panel forming at least a portion of an outer appearance of the indoor device;

a receiver window mounted in an installation hole defined in the panel, the receiver window being formed of a light transmitting material;

a receiver disposed under the receiver window at a position that corresponds to a center of the receiver window to receive a manipulation signal of a remote controller; and at least one light emitting diode (LED) disposed adjacent to the receiver to emit light toward the receiver window, to display an operation state of the indoor device to an outside of the indoor device, wherein the receiver window includes:

an exposed portion having a shape corresponding to a shape of the installation hole and mounted in the installation hole; and a stepped portion which is stepped to protrude outward from the exposed portion, wherein the installation hole has a shape corresponding to a shape of the exposed portion, and wherein the at least one LED is disposed outside of a periphery of the installation hole at a position that corresponds to the stepped portion of the receiver window.

2. The indoor device according to claim 1, wherein the indoor device further comprises:

an inspection hole defined on the panel;

a corner cover that opens and closes the inspection hole, the corner cover having the installation hole; and a controller mounted inside the corner cover, and having the receiver and the at least one LED.

3. The indoor device according to claim 2, wherein the controller comprises:

a case fixed to the corner cover to define an exterior thereof; and a PCB mounted inside the case, wherein the at least one LED and the receiver are mounted on the PCB.

4. The indoor device according to claim 2, wherein a connector fixing portion for a connector that connects an electric wire that extends from the controller to an electric wire that extends from an electronic component is further disposed in the inspection hole.

5. The indoor device according to claim 4, wherein the connector is mounted on the connector fixing portion in a state in which the connector is spaced apart from a wall of the inspection hole.

6. The indoor device according to claim 4, wherein the connector is mounted on the connector fixing portion so that the electric wires are connected to each other in a vertical direction.

7. The indoor device according to claim 1, wherein the at least one LED and the receiver are mounted on a printed circuit board (PCB).

8. The indoor device according to claim 7, further comprising a support disposed between the PCB and the receiver.

9. The indoor device according to claim 8, wherein the support is in the form of a rod that allows the receiver to be positioned at a position corresponding to a center of the receiver window and connected to the PCB at an off-center position.

10. The indoor device according to claim 1, wherein the receiver is disposed at a position which is closer to the receiver window than the at least one LED.

11. The indoor device according to claim 1, wherein at least one LED is disposed on each of both lateral sides of the receiver.

12. The indoor device according to claim 1, wherein the at least one LED emits light from a first side of the receiver window toward a second side of the receiver window.

13. The indoor device according to claim 1, wherein the at least one LED emits light having a plurality of colors.

14. The indoor device according to claim 1, wherein the at least one LED emits light having three colors.

15. The indoor device according to claim 1, wherein the at least one LED comprises a plurality of LEDs, wherein the plurality of LEDs is disposed at a same distance from the receiver, and wherein the plurality of LEDs emits light having colors different from each other.

16. The indoor device according to claim 1, wherein a groove or pattern is provided in an inner surface of the receiver window to diffuse the light emitted from the at least one LED.

17. The indoor device according to claim 1, wherein the receiver window comprises an extension that extends from an inner surface of the receiver window and disposed at a position that corresponds to the at least one LED and that protrudes along an extension line of the at least one LED to disperse the light emitted from the at least one LED.

* * * * *